US005813662A

United States Patent [19]

Langkruis

[11] Patent Number: 5,813,662

[45] Date of Patent: Sep. 29, 1998

[54] PORTABLE FENCING SYSTEM

[75] Inventor: Marinus Johannes Langkruis, Beamsville, Canada

[73] Assignee: Cramaro Tarpaulin Systems, Inc., Canada

[21] Appl. No.: 912,383

[22] Filed: Aug. 18, 1997

[51] Int. Cl.[6] ..... E04H 17/18

[52] U.S. Cl. ..... 256/25; 256/24; 248/910; 160/135

[58] Field of Search ..... 256/24, 25, 31, 256/19, 13.1, DIG. 6–26; 160/138, 351; 249/910, 519

[56] References Cited

U.S. PATENT DOCUMENTS

| | | | |
|---|---|---|---|
| 3,415,475 | 12/1968 | Goodman | 248/910 X |
| 3,877,681 | 4/1975 | Humphrey | 256/1 X |
| 4,787,603 | 11/1988 | Norton | 256/31 X |
| 5,088,680 | 2/1992 | Farmer | 248/910 X |
| 5,220,740 | 6/1993 | Brault | 248/910 X |
| 5,402,999 | 4/1995 | Keehn, Sr. | 160/135 X |
| 5,460,353 | 10/1995 | Rittenhouse | 256/24 X |
| 5,676,350 | 10/1997 | Galli et al. | 256/DIG. 6 X |

FOREIGN PATENT DOCUMENTS

| | | | |
|---|---|---|---|
| 2248860 | 4/1992 | United Kingdom | 256/31 |
| 2252775 | 8/1992 | United Kingdom | 256/24 |

*Primary Examiner*—Harry C. Kim
*Attorney, Agent, or Firm*—Connolly & Hutz

[57] ABSTRACT

A portable fencing system includes a plurality of fence sections each of which terminates in feet which are selectively mounted in base blocks. Each base block includes a section made in the form of a skin having a hollow chamber therein with filler material inserted in the chamber.

16 Claims, 2 Drawing Sheets

PORTABLE FENCING SYSTEM

BACKGROUND OF THE INVENTION

Portable fencing systems are desirable to customize a fenced-in area in a quick and efficient manner so that the fenced-in area could be set up in a variety of configurations to fit a multitude of applications. The resultant fenced-in area could be used, for example, in indoor or outdoor compounds, at construction/roofing sites, for seasonal display items, for garden centers, for outdoor special events, for crowd control, for repair and renovation area, for property fencing for tool rooms, etc.

One known portable fencing system includes a plurality of fence sections which have fence walls made, for example, of galvanized steel with the wall sections having legs extending downwardly from the wall section. Base blocks are positioned at suitable locations. The base blocks include holes for receiving the legs. In this known system, the base blocks are concrete blocks which weigh, for example, 60 to 90 pounds each, thus allowing the blocks to be installed on any surface and because of its weight providing a stable mounting of the fenced sections.

A disadvantage with the base blocks of the known portable fencing system is that such blocks are not only very heavy but because the blocks are made of concrete, if the blocks should be dropped they would tend to crack.

SUMMARY OF THE INVENTION

An object of this invention is to provide a portable fencing system which incorporates base blocks having improved structure over the above indicated known system.

A further object of this invention is to provide such a system which incorporates all of the advantages of the above known system while eliminating some of its disadvantages.

In accordance with this invention the base block is made at least partially from an outer skin which forms a hollow chamber. The hollow chamber includes a heavy filler material such as water, sand or concrete. Thus, if the block is accidentally dropped the outer skin will remain intact and would still include the heavy filler material within its chamber.

THE DRAWINGS

DETAILED DESCRIPTION

Figure 4:
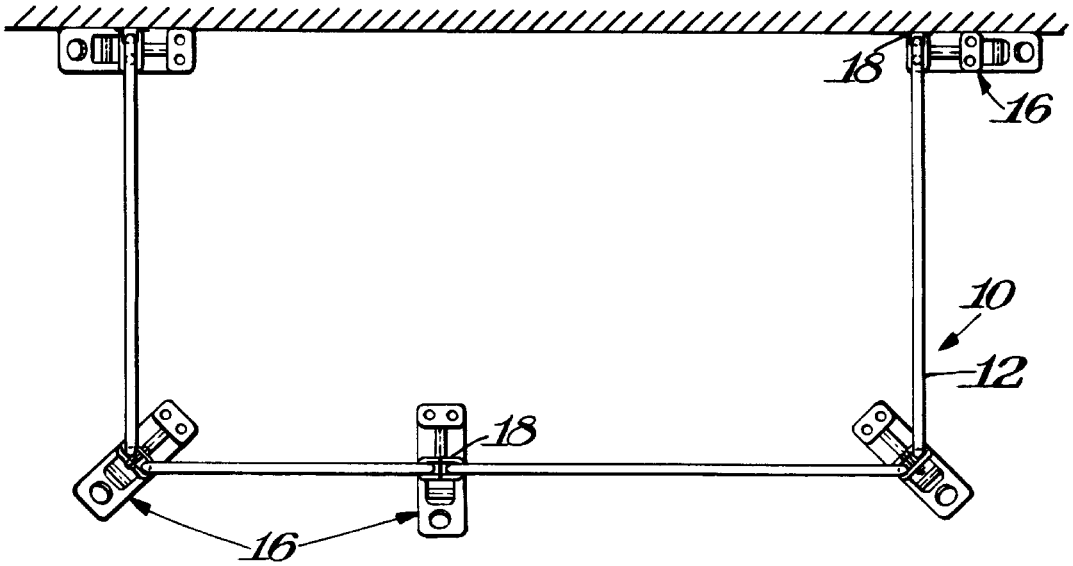
FIG. 4 is a top plan view showing a portable fencing system in accordance with this invention utilizing the base block shown in FIGS. 1–3.
Figure 5:
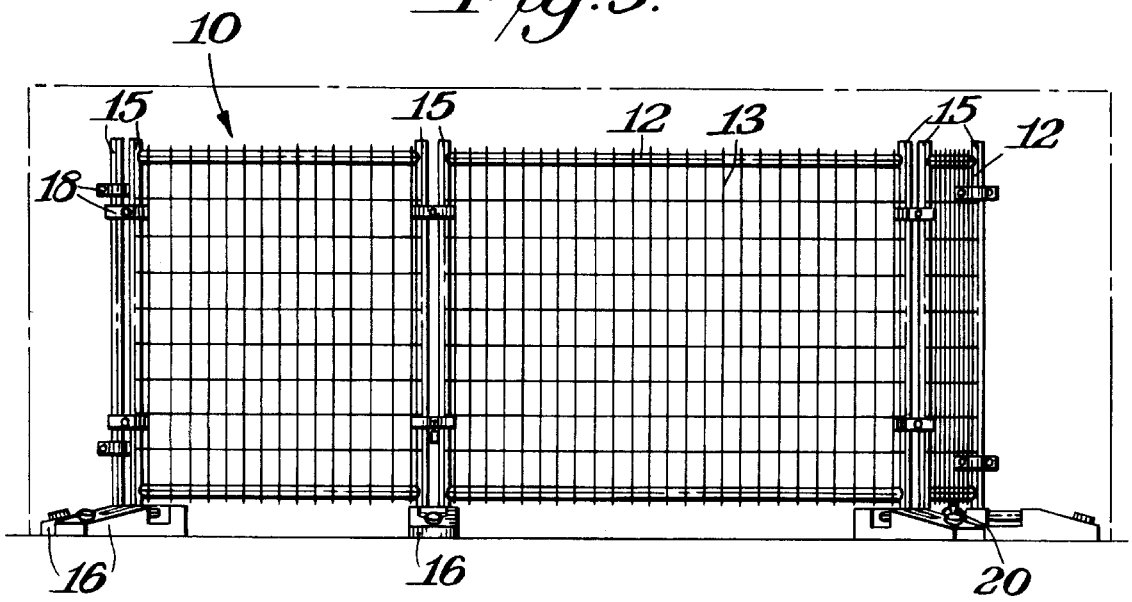
FIG. 5 is an elevation view of the portable fencing system shown in FIG. 4.

The present invention relates to improvements in portable fencing systems of the type which include a plurality of fence sections. As shown in FIGS. 4–5 the portable fencing system 10 includes a plurality of fence sections 12 made of any suitable construction. Preferably the fence structures are of mesh-type structure made from durable hot dipped galvanized steel construction to withstand all weather. Thus, each fence section 12 includes a mesh type wall portion 13.

The ends of each fence section include rigid posts 15 which extend below the wall 13 to form legs 14 with each leg 14 being inserted into a corresponding hole in a base block 16, as shown in phantom in FIGS. 2–3. The adjacent fence sections 12 may be secured together in any suitable manner, such as by wall clamps 18 which permit pivotal movement of the fence sections with respect to each other. If desired, a wheel 20 could be provided for one or more sections to permit that section to function as a gate.

In operation when it is desired to provide a fenced area the general area would be marked out and base blocks 16 would be placed at the proper locations corresponding to the fence length. Each base block 16 includes a set of two center holes 22 and a set of two end holes 24. The blocks would be located so that the appropriate set of center holes or end holes is positioned to receive the corresponding legs 14 of the fence sections. The fence sections would then be installed by inserting the legs 14 into the appropriate holes 22 or 24. Adjacent sections would be secured together through use of the clamps 18.

Figure 1:
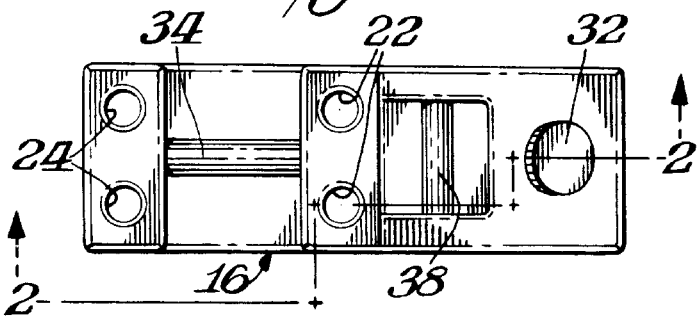
FIG. 1 is a top plan view of a base block used in a portable fencing system in accordance with this invention.

The invention is directed primarily to the construction of the base blocks 16. As shown in FIGS. 1–3, each base block 16 is made at least partially from an outer skin material 26 which forms a hollow chamber 28. The skin material is made from a sufficiently durable, rigid material, such as PVC, so as to withstand rough use. In a preferred practice of the invention the entire block 16 could be made of the plastic skin material. Thus, the block itself is relatively lightweight.

The hollow chamber 28 includes a fill opening 30 covered by a removable closure 32 which could be screwed into the opening or fit into the opening 30 in any suitable manner. Preferably, the closure 32 is a thin welded fitting for filling or emptying the chamber 28. Closure 32 would be removed to expose the chamber and the chamber would be at least partially filled with a heavy filler material 40 such as water, sand or concrete. Where concrete is used as the filler material the concrete could be mixed and poured in situ for being inserted in the chamber 28. The closure 32 would then be reattached to cover fill opening 30. As a result, a heavy block results which provides stability in anchoring the fence sections. If desired, the blocks 16 could be prefilled or could be filled at the site of the fencing location.

Figure 2:
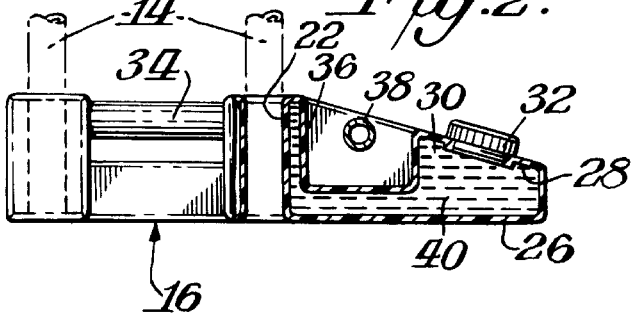
FIG. 2 is a cross-sectional view taken through FIG. 1 along the line 2—2.
Figure 3:
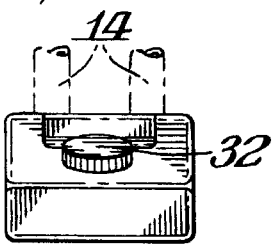
FIG. 3 is an end elevational view of the base block shown in FIG. 1.

As shown in FIGS. 1–3 the block 16 includes a handle 34 which spans the set of holes 22,24. Handle 34 is located generally along the longitudinal axis or centerline of block 16 and is located in the half of the block opposite the half of the block having the chamber 28. Chamber 28 includes an external depression or recess 36 so as to accommodate a second handle 38 that spans the recess in a direction perpendicular to handle 34. Thus, the two handles 34,38 provide a ready manner for easily carrying and properly placing the block 16. Preferably, the handles 34,38 are made of tubular form and likewise could be made of PVC material. The provision of the two handles 34,38 makes the moving and dumping of the chamber much easier in a practice of the invention.

As best shown in FIG. 2 the upper surface of block 16 on its half which contains the chamber 28 is downwardly inclined so as to minimize any interference with the placement of the legs 16 in the proper holes 22 or 24.

The block 16 may have an overall length of 27 inches and a maximum height at the holes 22,24 of 5.75 inches. Except for the filler material the entire block 16 could be made of PVC or other material used to form the outer skin.

As best illustrated in FIGS. 4–5 the provision of two sets of holes 22,24 provides the user with selectivity in the placement of the fence sections so that either set of holes 22 or 24 may be used as appropriate.

The present invention represents a marked improvement over prior portable fencing systems which utilize base blocks made of concrete. Even where the filler material 40 in the chamber 28 is itself made of concrete, if the block 16 should be dropped and the concrete filler material cracked, the filler material 40 would still be retained in the chamber 28 so as to continue to function in the intended manner. Where the filler material is of a flowable nature, such as water or sand, no change results from dropping the block 16.

What is claimed is:

1. In a portable fencing system having a plurality of fence sections, each of said fence sections having a side wall portion and at least one foot extending downwardly below said wall portion, a plurality of base blocks, each of said base blocks having at least one longitudinal hole exposed on its upper surface, and said foot of one of said fence sections being inserted in said hole of one of said base blocks, the improvement being in that at least a portion of said base block is made of an outer skin to form a hollow chamber, a heavy filler material being in said hollow chamber to increase the weight of said base block for adding stability to said base block and to said fence sections and to maintain said base block intact in the event of said base block being dropped, including handles on said block, said handles comprising a first handle located remote from said chamber and a second handle located directly above said chamber, said block having an external depression in said upper surface directly above said chamber, and said second handle being located in said depression.

2. The system of claim 1 wherein said chamber includes a fill opening through which said filler material can be inserted.

3. The system of claim 2 including a removable closure selectively opening and closing said fill opening.

4. The system of claim 3 wherein said filler material is water.

5. The system of claim 3 wherein said filler material is sand.

6. The system of claim 3 wherein said skin is made of PVC.

7. The system of claim 6 wherein said entire base block is made of said outer skin.

8. The system of claim 2 wherein said filler material is concrete.

9. The system of claim 2 wherein said first handle extends generally along the longitudinal centerline of said block, and said second handle disposed perpendicular to said first handle.

10. The system of claim 9 wherein said block has a downwardly extending upper surface located above said chamber, and said block including a set of center holes adjacent to said chamber for selectively receiving said feet.

11. The system of claim 1 wherein said block further includes a set of two end holes located remote from said chamber.

12. The system of claim 1 wherein said entire base block is made of said outer skin.

13. In a portable fencing system having a plurality of fence sections, each of said fence sections having a side wall portion and at least one foot extending downwardly below said wall portion, a plurality of base blocks, each of said base blocks having at least one longitudinal hole exposed on its upper surface, and said foot of one of said fence sections being inserted in said hole of one of said base blocks, the improvement being in that at least a portion of said base block is made of an outer skin to form a hollow chamber, a heavy filler material being in said hollow chamber to increase the weight of said base block for adding stability to said base block and to said fence sections and to maintain said base block intact in the event of said base block being dropped, a first handle on said block remote from said chamber, a second handle on said block located directly above said chamber, and said hole being located between said first handle and said second handle whereby said handles would be disposed on opposite sides of said one of said fence sections when said foot is inserted in said hole.

14. The system of claim 13 wherein said block further includes a set of two end holes located remote from said chamber, and said two end holes being disposed between said first handle and said second handle.

15. The system of claim 14 wherein said first handle extends generally along the longitudinal center line of said block, and said second handle being disposed perpendicular to said first handle.

16. The system of claim 13 wherein said first handle extends generally along the longitudinal center line of said block, and said second handle being disposed perpendicular to said first handle.

* * * * *